US011576492B2

(12) United States Patent
Smit

(10) Patent No.: US 11,576,492 B2
(45) Date of Patent: Feb. 14, 2023

(54) DIVISIBLE SHELL FOR A SEAT

(71) Applicant: F. SMIT HOLDING B.V., Doetinchem (NL)

(72) Inventor: Fernando Smit, Doetinchem (NL)

(73) Assignee: F. SMIT HOLDING B.V., Doetinchem (NL)

( * ) Notice: Subject to any disclaimer, the term of this patent is extended or adjusted under 35 U.S.C. 154(b) by 0 days.

(21) Appl. No.: 16/966,053

(22) PCT Filed: Feb. 21, 2019

(86) PCT No.: PCT/NL2019/050115
§ 371 (c)(1),
(2) Date: Jul. 30, 2020

(87) PCT Pub. No.: WO2019/164396
PCT Pub. Date: Aug. 29, 2019

(65) Prior Publication Data

US 2020/0397143 A1 Dec. 24, 2020

(30) Foreign Application Priority Data

Feb. 21, 2018 (NL) ..... 2020467

(51) Int. Cl.
*A47C 3/12* (2006.01)
*A47C 4/02* (2006.01)
*A47C 5/12* (2006.01)

(52) U.S. Cl.
CPC . *A47C 3/12* (2013.01); *A47C 5/12* (2013.01)

(58) Field of Classification Search
CPC ..... A47C 3/12; A47C 5/12
(Continued)

(56) References Cited

U.S. PATENT DOCUMENTS 1,078,810 A * 11/1913 Van Derveer ..... A47C 4/02 297/440.15
2,620,024 A * 12/1952 Rietman ..... A47C 4/02 297/440.23

(Continued)

FOREIGN PATENT DOCUMENTS

DE 102008032231 A1 1/2009
FR 2895219 A1 6/2007

(Continued)

OTHER PUBLICATIONS

International Search Report and Written Opinion for the International Patent Application No. PCT/NL2019/050115, dated Jun. 21, 2019, 9 pages.

*Primary Examiner* — Rodney B White
(74) *Attorney, Agent, or Firm* — KDB Firm PLLC

(57) ABSTRACT

A shell for a seat, particularly for a simulator, includes a seat surface, a backrest and side parts. The shell includes two or more shell parts connected releasably to each other. The shell parts are connectable to each other along a dividing plane. The dividing plane can run substantially parallel to or enclose a small angle with a plane which connects a front side of the seat surface to an upper side of the backrest, and the shell parts can extend substantially equally far from the dividing plane in a direction transversely thereof. A method for transporting a shell for a seat includes: providing two shell parts which can be connected releasably to each other to form the shell; placing the shell parts in each other; and placing the shell parts which are placed in each other in a packaging.

14 Claims, 6 Drawing Sheets

Figure 1:
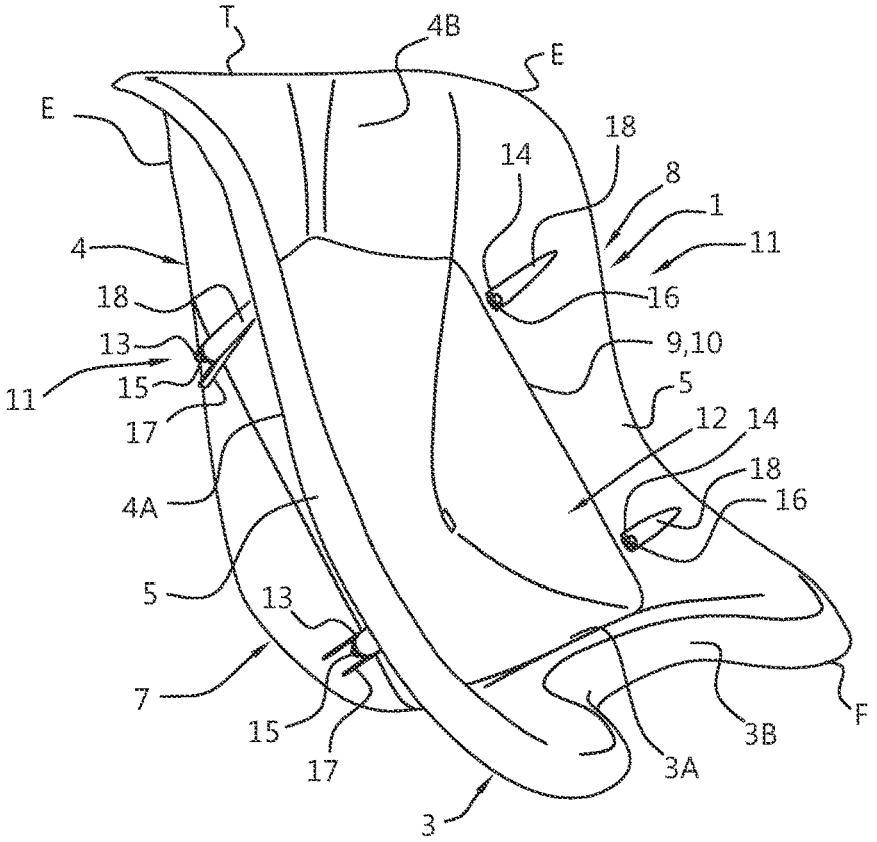

(58) Field of Classification Search
USPC ..... 297/440.15, 440.2, 451.11, 451.12, 297/451.13, 451.4, 451.5, 451.6, 462, 297/452.11, 452.14
See application file for complete search history.

(56) References Cited

U.S. PATENT DOCUMENTS 3,033,732 A * 5/1962 Yellen, Jr. ..... A47C 3/12 297/452.11 X
3,301,597 A * 1/1967 Bereday ..... A47C 4/02 297/450.1
3,596,986 A * 8/1971 Ragsdale ..... B60N 2/2863 297/452.14 X
3,642,323 A * 2/1972 Taylor ..... A47C 5/125 297/451.11 X
3,669,495 A * 6/1972 Von Rudgisch ..... A47C 4/02 297/440.15 X
3,747,978 A * 7/1973 Barecki ..... A47C 5/043 297/451.4
3,841,704 A * 10/1974 Platner ..... A47C 3/12 297/440.2 X
3,964,790 A * 6/1976 Bergeron ..... A47C 3/04 297/451.5
3,999,801 A * 12/1976 Walters ..... A47C 3/12 297/451.4
4,077,517 A * 3/1978 Hilemn ..... A47C 4/02 297/440.1 X
4,123,105 A * 10/1978 Frey ..... A47C 5/12 297/451.1
4,275,925 A * 6/1981 Harder, Jr. ..... B60N 2/242 297/452.2
4,510,634 A * 4/1985 Diedrich ..... A47D 13/02 297/452.14 X
4,611,852 A * 9/1986 Filer ..... A47C 1/16 297/440.15 X
4,776,635 A * 10/1988 Halliez ..... B61D 33/00 297/440.15
4,919,485 A * 4/1990 Guichon ..... A47C 4/03 297/440.15 X
5,018,788 A * 5/1991 Cedergreen ..... A47C 3/16 297/378.1
5,074,621 A * 12/1991 McDonald ..... A47C 7/42 297/440.15
5,498,065 A * 3/1996 Tosoni ..... A47C 5/12 297/411.41
5,785,383 A * 7/1998 Otero ..... A47D 1/02 297/255
5,820,220 A * 10/1998 Wu ..... A47C 7/407 297/378.1
5,992,936 A * 11/1999 Greaves ..... A47C 3/16 297/440.2 X
6,033,019 A * 3/2000 Hession-Kunz ..... A47D 1/002 297/250.1
6,422,654 B1 * 7/2002 Grove ..... A47C 7/42 297/440.15 X
6,713,001 B1 3/2004 Cannon et al.
6,783,182 B1 * 8/2004 Gallagher ..... A47C 4/02 297/440.14
7,021,710 B2 * 4/2006 Kain ..... B60N 2/2851 297/440.15 X
7,303,230 B2 * 12/2007 Munn ..... B60N 2/20 297/440.15 X
7,472,959 B1 * 1/2009 Ratza ..... A47C 7/407 297/440.15 X
7,669,926 B2 * 3/2010 Balensiefer ..... B60N 2/2866 297/256.11
7,681,956 B2 * 3/2010 Huang ..... A47C 3/00 297/440.16
8,096,621 B2 * 1/2012 Braun ..... B60N 2/682 297/440.15
8,152,238 B2 * 4/2012 Timme ..... B08B 3/02 297/440.15 X
8,646,843 B2 * 2/2014 Koch ..... A47C 17/02 297/440.15 X
9,221,365 B2 * 12/2015 Williams ..... B60N 2/2851
9,517,710 B2 * 12/2016 Correia ..... B60N 2/682
9,586,507 B2 * 3/2017 Correia ..... B60N 2/682
10,561,245 B2 * 2/2020 Hashemi ..... E04H 3/30
10,632,871 B2 * 4/2020 Schmitz ..... B60N 2/2851
2004/0124677 A1 * 7/2004 Meeker ..... B60N 2/2872 297/255
2004/0189076 A1 * 9/2004 Hanson ..... B62B 7/123 297/440.15
2005/0029855 A1 * 2/2005 Hanson ..... A61G 5/0891 297/440.15
2005/0099051 A1 * 5/2005 Taylor ..... A47C 7/14 297/451.6 X
2006/0138848 A1 * 6/2006 Balensiefer ..... B60N 2/75 297/440.16
2007/0236061 A1 * 10/2007 Meeker ..... B60N 2/20 297/250.1
2016/0016487 A1 * 1/2016 Correia ..... B60N 2/015 297/94
2016/0016491 A1 * 1/2016 Correia ..... B60R 11/00 296/64
2016/0374468 A1 * 12/2016 Hashemi ..... A47C 7/626 297/452.1 X

FOREIGN PATENT DOCUMENTS

GB 2281200 A 3/1995
JP 06154057 A * 6/1994

* cited by examiner

DIVISIBLE SHELL FOR A SEAT

This is a national stage application filed under 35 U.S.C. § 371 of pending international application PCT/NL2019/050115, filed Feb. 21, 2019, which claims priority to Netherlands Patent Application No. NL 2020467, filed Feb. 21, 2018, the entirety of which applications are hereby incorporated by reference herein.

The invention relates to a shell for a seat, particularly for a simulator, comprising a seat surface, a backrest and side parts. Such a shell is known, and is for instance used in race or rally simulators. One or more cushions or another type of filling can be arranged in the shell, after which the shell can be upholstered, for instance with a cover, thus forming a seat. The term "seat" is here also understood to mean a simple bucket seat. The seat here resembles a bucket seat as used in a race or rally car, or a small bucket seat used in a go-kart.

A large number of products is currently sold through online sales channels or online shops. For such products it is of great importance that they can be transported efficiently. This can be achieved when the products can be transported in relatively small packagings. Incidentally, this applies not only to online shops, it is also important for brick and mortar shops that products can be packaged in efficient manner. On the one hand, this makes it possible to minimize the storage and transport costs, while the shop capacity, particularly the floorspace available in the shop, can in addition be utilized optimally.

Seats consisting in particular from a seat surface and a backrest, such as for instance desk chairs, can usually be packaged efficiently in that the seat surface and the backrest can be detached from each other and can then be placed flat on top of each other. In the case of bucket seats this is not possible.

The invention has for its object to provide a shell for a seat of the above described type, which can be received in a relatively small packaging and can be transported and stored efficiently. This is achieved according to the invention in that the shell comprises at least two shell parts connected releasably to each other. By embodying the shell in parts it can be packaged more efficiently than an integrally formed shell, whereby a smaller packaging can suffice.

The shell parts are preferably connected to each other along a dividing plane. The connection is hereby distributed over a large area, so that stresses remain limited.

The dividing plane can advantageously run substantially parallel to or enclose a small angle with a plane which connects a front side of the seat surface to an upper side of the backrest. By having the dividing plane run roughly parallel to the connecting line between the outer ends of the seat surface and the backrest an efficient division is achieved.

An effective division of the shell is achieved when each shell part comprises a part of the seat surface and a part of the backrest. The shell can thus be packaged smaller than in the case of a division between seat surface and backrest, as is usual in other types of seat.

The shell parts here preferably extend substantially equally far from the dividing plane in a direction transversely thereof. The largest dimension of a shell is thus in fact divided in two.

Each shell part can have an edge at the position of the dividing plane, and the edges of the shell parts can be connected to each other. A strong connection between the two shell parts, and thereby a stable seat, is thus obtained.

Each edge can here comprise at least one flange protruding toward the outer side of the shell part, and the flanges can be connected to each other. A flange connection is robust, and by placing it on the outer side the dimensions of the flanges can be chosen freely, without this affecting the seating comfort.

On the other hand, it is also possible to envisage the edges overlapping each other at least over a part of their periphery. In this way a strong connection is also formed, wherein protruding parts on the outer side of the shell are avoided and the seating comfort also remains unaffected.

The edges can have complementary courses which deviate locally from the dividing plane. By having the edges as it were protrude above or below the dividing plane locally, co-acting recesses and protrusions are formed, whereby the shell parts can be assembled form-fittingly. An accurate positioning of the shell parts relative to each other is hereby guaranteed, while the connection of the edges is moreover stronger than would be possible with straight edges.

One of the shell parts can be an outer part having an opening bounded by its respective edge while the other shell part can be an inner part bounded by its outer edge, and the inner shell part can fit overturned in the opening in the outer shell part. In this way the outer shell part substantially surrounds the inner shell part, and the shell can be made smaller in very simple manner.

In order to obtain a strong shell, and thereby a stable seat, each shell part can have connecting means co-acting with the other shell part. These connecting means can for instance comprise bolts and nuts, but simple clamps or other types of connecting means can also be envisaged.

These connecting means can be arranged at least partially on the outer side of each shell part so that they do not affect the seating comfort.

At least one of the shell parts can be manufactured by injection molding of a plastic. Both shell parts are preferably injection molded. In this way the shell can be produced relatively easily in large numbers and at low cost. This is particularly the case when the shell is intended to form a go-kart seat, which is relatively small and light.

On the other hand, it is also possible to envisage at least one of the shell parts being manufactured from a composite material, particularly a fiber-reinforced plastic. A composite material is harder to work with than a simple plastic, but has better properties, particularly a greater strength and rigidity. Composite material is thus especially suitable for shells which are subject to relatively heavier loads, for instance for a racing or rally seat.

The invention also relates to a method for transporting a shell for a seat, particularly a simulator seat, comprising a seat surface, a backrest and side parts. According to the invention, this method is characterized by the steps of providing at least two shell parts which can be connected releasably to each other to form the shell, placing the shell parts in each other, and placing the shell parts which are placed in each other in a packaging. By placing the shell parts in the packaging in each other it is possible to suffice with a relatively compact packaging, which is highly suitable to be placed on pallets, for instance europallets, in relatively large quantities.

When the shell parts can be connected to each other along a dividing plane and each shell part has at the position of the dividing plane an edge which bounds an opening, the step of placing the shell parts in each other preferably comprises of placing one of the shell parts in the opening of the other shell part. The shell parts can thus be placed in each other in very space-saving manner.

When the shell parts can be connected to each other in a first position to form the seat, the shell part to be placed in the opening is preferably placed in the opening overturned relative to the first position. Because the shell parts can together form a continuous shell, they also fit precisely in each other the other way around.

The method according to the invention further has the provision that at their destination the shell parts are removed from the packaging, are separated from each other and are connected releasably to each other to form a seat. This can for instance be done by an end user of the seat.

After being separated, one of the shell parts can here advantageously be turned around before the shell parts are connected to each other.

Finally, the invention also relates to a packaging with shell parts placed therein, which is evidently formed by application of the above described method.

Figure 2:
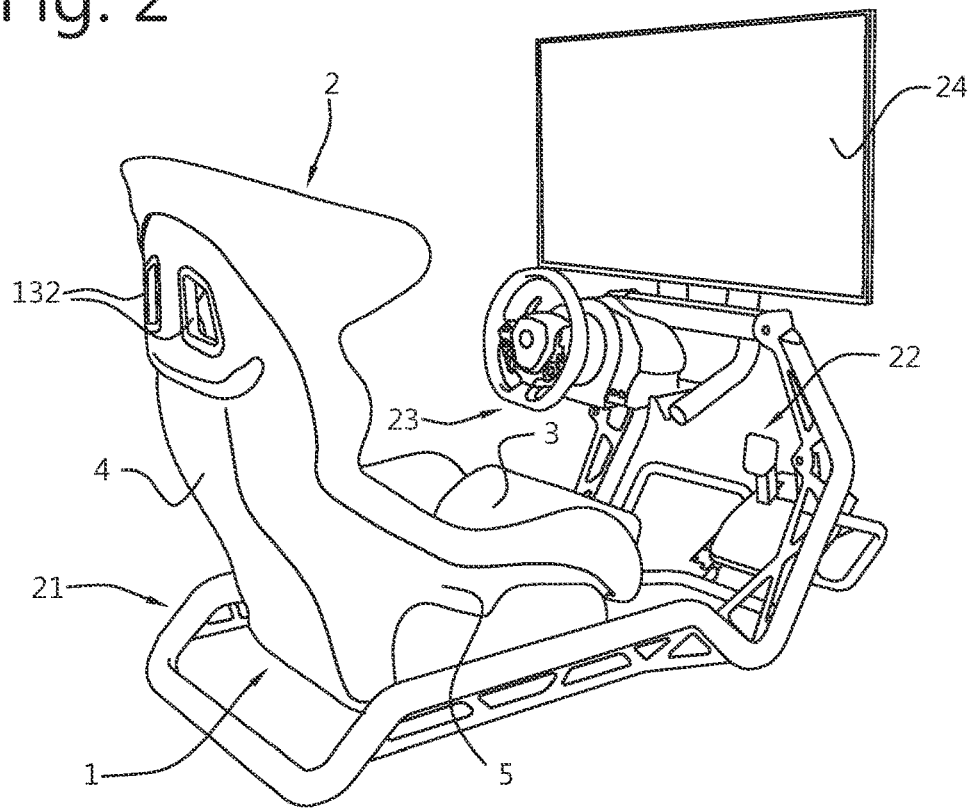
Figure 3:
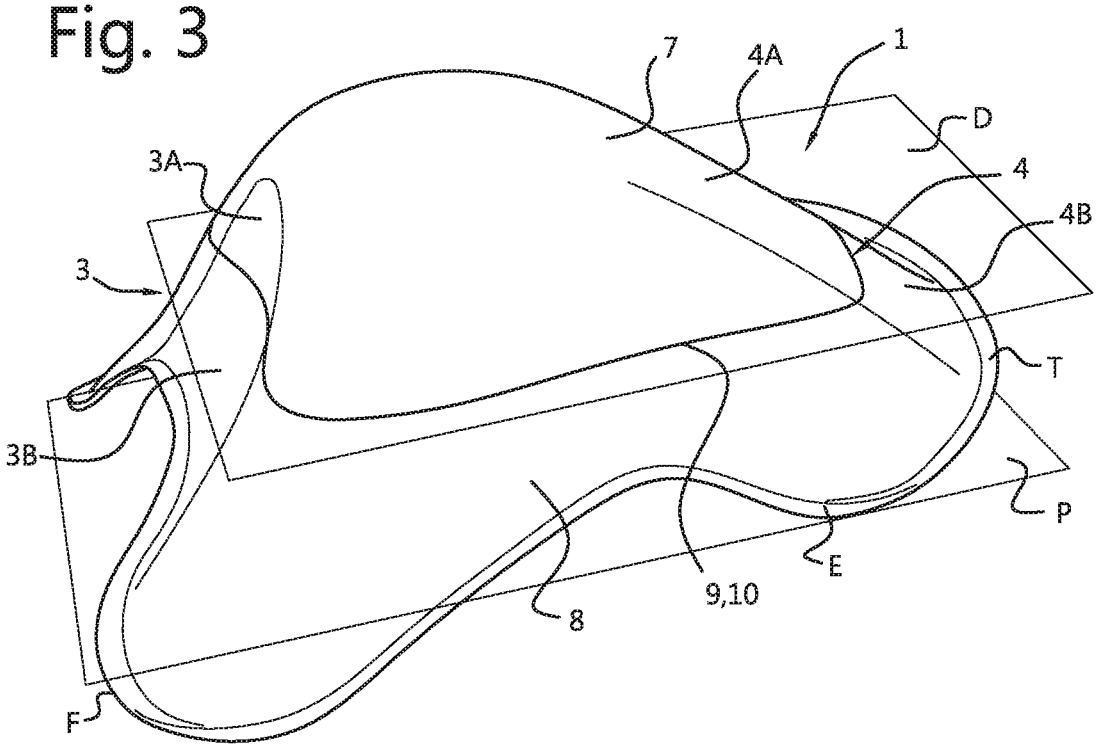
Figure 4:
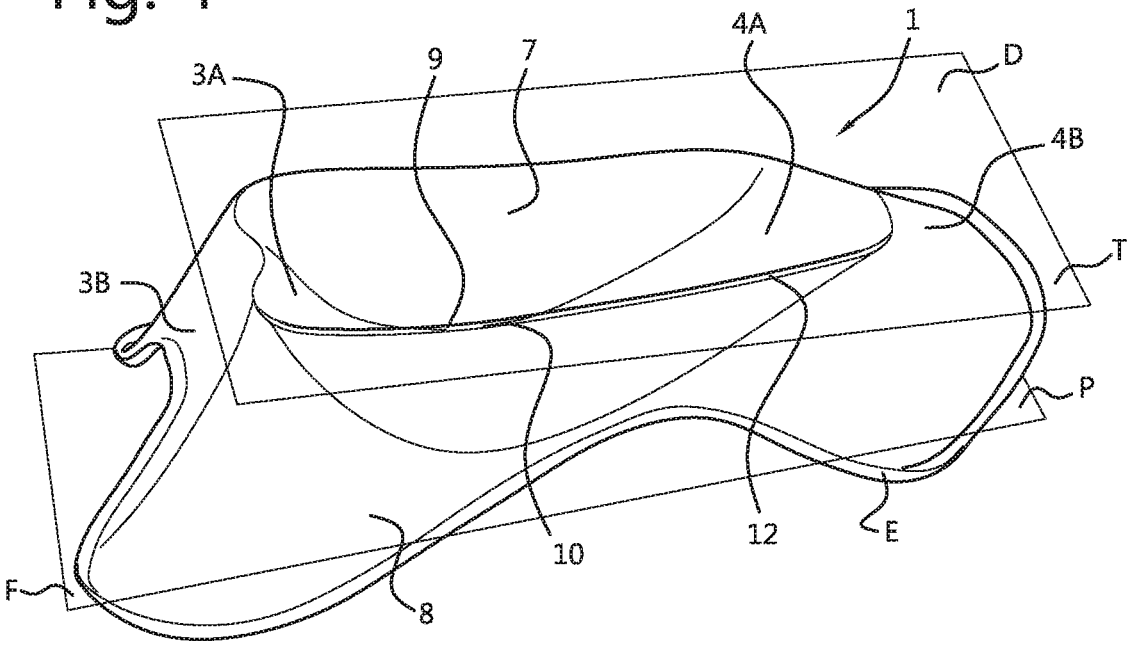
Figure 5:
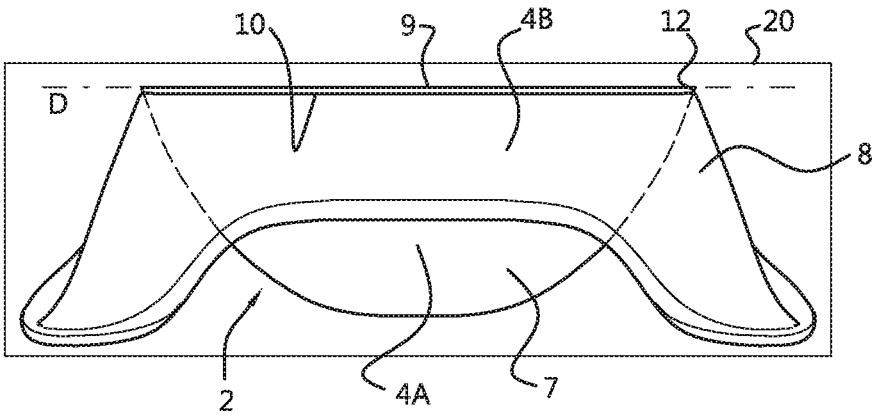
Figure 6:
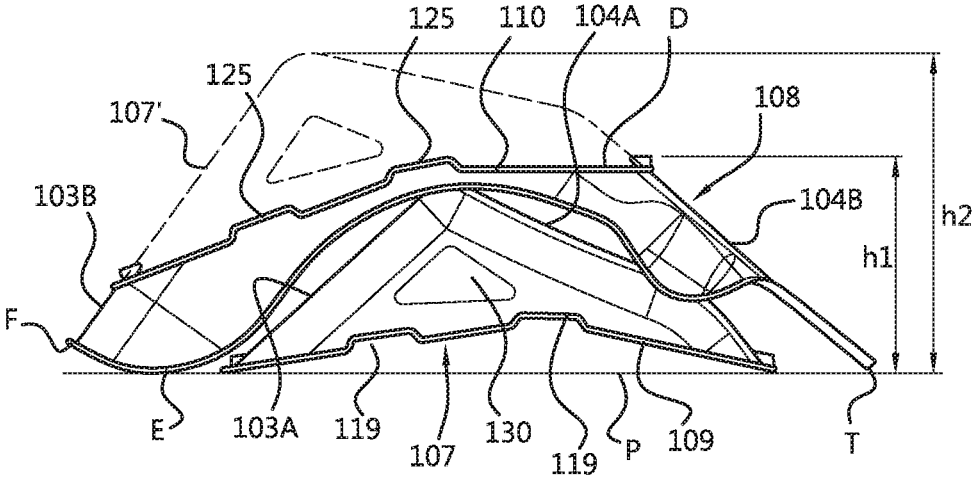
Figure 8:
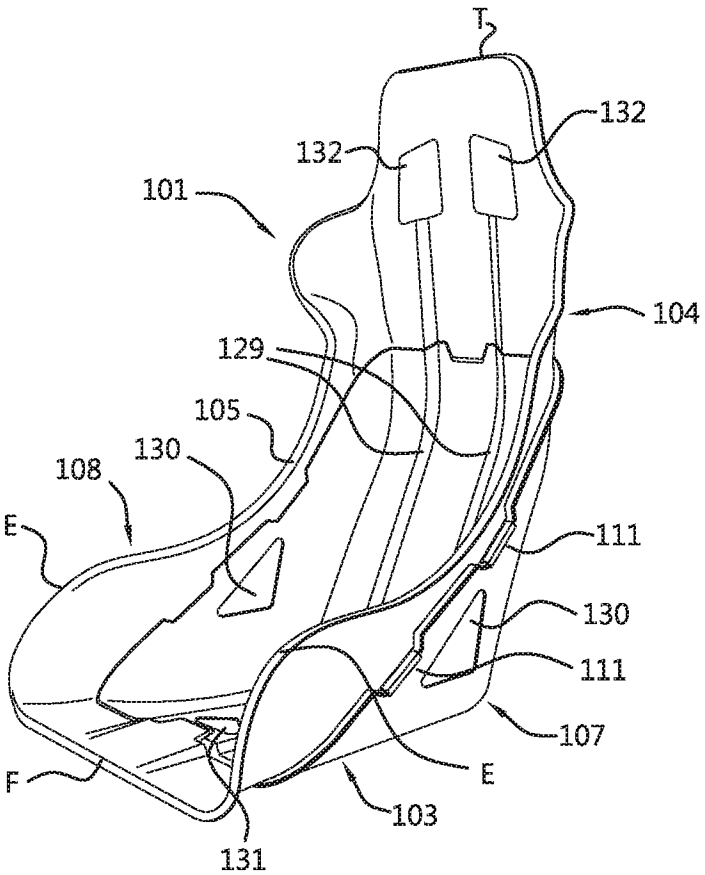
Figure 7:
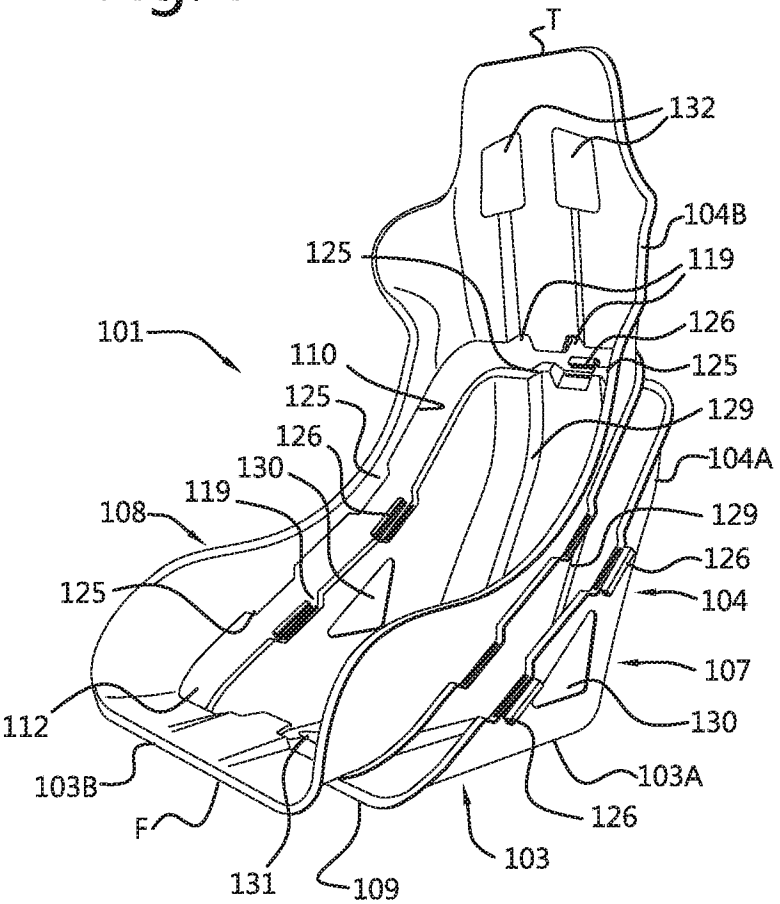
Figure 9:
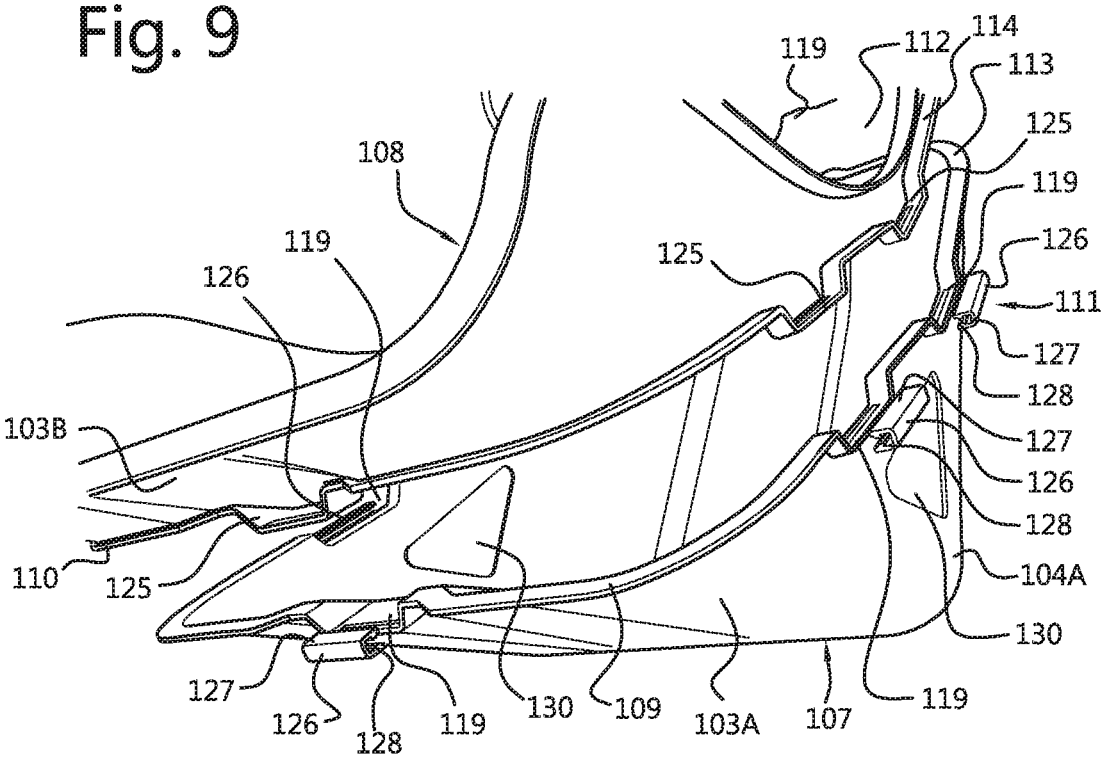
Figure 10:
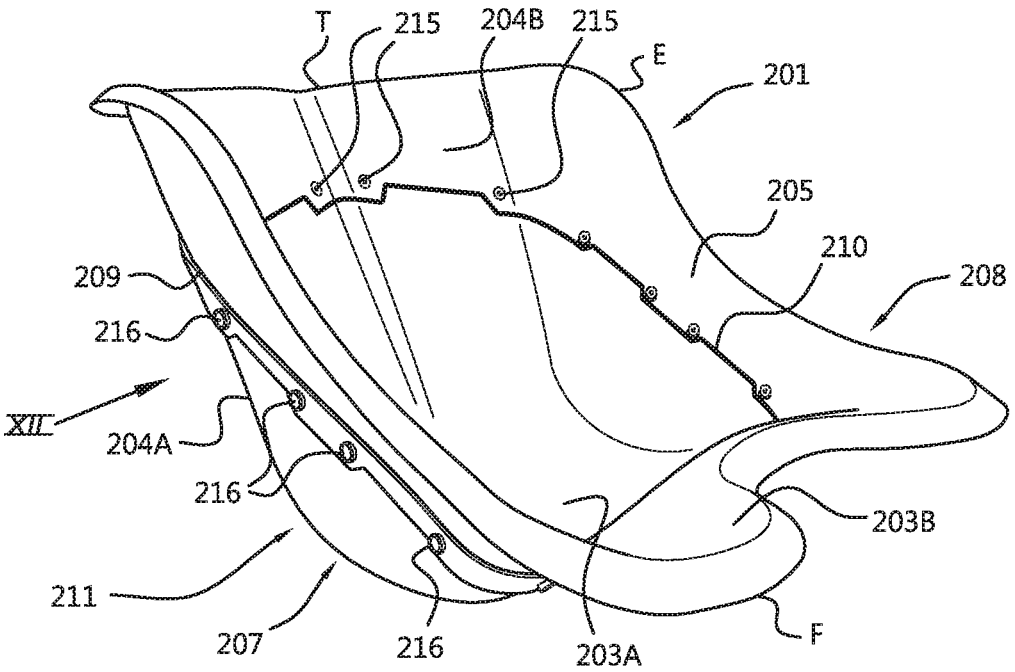
Figure 11:
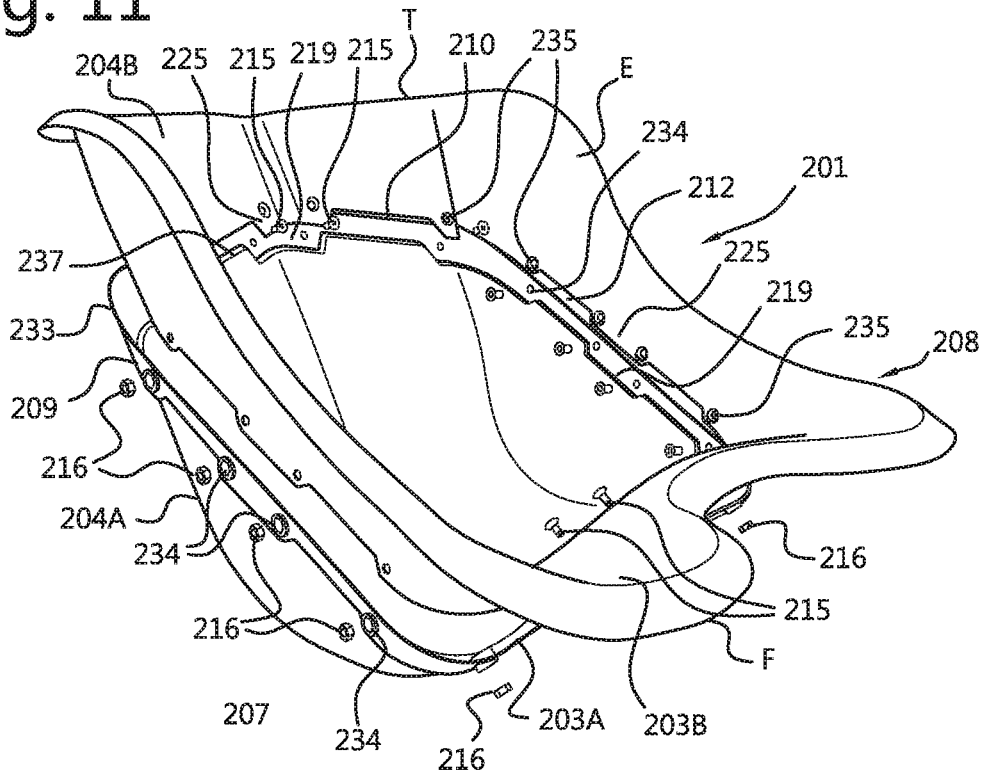
Figure 12:
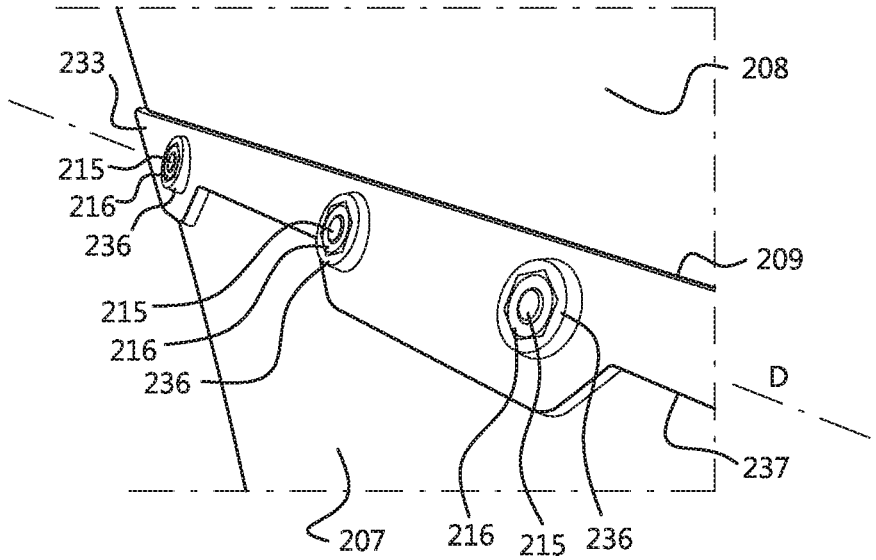

The invention is elucidated hereinbelow on the basis of a number of embodiments, wherein reference is made to the accompanying drawing, in which corresponding components are designated with reference numerals increased by 100, and in which:

FIG. 1 is a perspective view of a first embodiment of a shell for a seat according to the invention, FIG. 2 is a seat in combination with a race simulator, FIG. 3 is a simplified perspective rear view of the shell for the seat of FIG. 1 in assembled state, wherein the connecting means have been omitted, FIG. 4 is a view corresponding to FIG. 3 of the shell in the transport position, wherein one of the shell parts is placed overturned in the other shell part, FIG. 5 is a schematic rear view of the shell parts which are placed in each other of FIG. 4 in a packaging, FIG. 6 is a schematic side view of two parts of a second embodiment of a shell for a seat according to the invention, which are placed one below the other, wherein the seat is shown schematically in assembled state for comparison, FIG. 7 is a perspective view of the shell parts of FIG. 6 and connecting means associated therewith, FIG. 8 is the shell created by assembly of the shell parts and associated with the seat according to FIG. 2, FIG. 9 is a perspective detail view on enlarged scale of the shell parts and connecting means of FIG. 7, FIG. 10 is a view corresponding to FIG. 1 of a third embodiment of the seat shell according to the invention, FIG. 11 is the shell of FIG. 10 in the non-assembled state, and FIG. 12 is a perspective detail view on enlarged scale as according to the arrow XII in FIG. 10.

FIG. 1 shows a shell 1 for a seat 2, which comprises a seat surface 3, a backrest 4 and side parts 5. Seat 2 is a so-called bucket seat, which is used in this form in for instance rally or race cars and in go-karts. In the shown example seat 2 is a go-kart seat which is intended for use in a simulator 6, as shown in FIG. 2. The seat 2 which is shown in FIG. 2 is otherwise based on a different type of shell, which is shown in FIGS. 6-9. Due to the deep form of bucket seat 2 with its high side parts or wings 5 it cannot be easily transported as a whole.

Shell 1 according to the invention therefore comprises two shell parts 7, 8 connected releasably to each other. In the shown example shell parts 7, 8 are connected to each other along a dividing plane D. This dividing plane D here runs substantially parallel to a plane P which connects a front side F of seat surface 3 to an upper side T of backrest 4 or to a forward protruding edge E of a side part 5 (FIG. 4).

The inner shell part 7 comprises a part 3A of seat surface 3 and a part 4A of backrest 4. Correspondingly, the outer shell part 8 comprises here a part 3B of seat surface 3 and a part 4B of backrest 4. Each shell part 7, 8 further comprises a portion of the side wings 5. In the shown example the outer shell part 8 forms as it were a collar around the inner shell part 7.

Each shell part 7, 8 has an edge 9, 10 at the position of the dividing plane D. Edge 9 forms an outer edge of inner shell part 7, while edge 10 bounds an opening 12 in the outer shell part 8. Each edge 9, 10 has one or more flanges 13, 14 which protrude toward the outer side of the relevant shell part 7, 8. Formed in these flanges 13, 14 are openings (not shown here) through which co-acting connecting means 11 of shell parts 7, 8 can be inserted. In the shown example each flange 13 of the inner shell part 7 is supported by ribs 17 on the outer side of shell part 1, while each flange 14 of the outer shell part 8 forms a bottom of a protrusion 18 of the wall of outer shell part 8.

In this way the connecting means 11, here taking the form of bolts 15 and nuts 16 fastened thereon, can be reached in simple manner from the inner side and the outer side of shell 1, while, after attaching of connecting means 11, they can be covered on the inner side of shell 1 by a filling and/or a covering to be arranged thereon. With the shown placing of flanges 13, 14 and connecting means 11 it is in any case prevented that parts of the connection protrude inside the internal contour of shell 1, where they could affect the seating comfort.

When shell parts 7, 8 are not connected to each other they can be placed in each other in simple manner, whereby seat shell 1 takes up considerably less space. Because shell parts 7, 8 form a continuous shell 1 in their mutually connected state, they also fit precisely into each other when one of the two shell parts 7, 8 is turned around relative to the connected position. This is because the outer edge 9 of inner shell part 7 and the edge 10 of opening 12 of outer shell part 8 follow the same course.

In the shown example inner shell part 7 can be suspended, after being turned around, in the opening 12 of outer shell part 8, wherein the edge 9 of inner shell part 7 rests on the edge 10 of outer shell part 8 (FIG. 4). Because the dividing plane D is chosen such that the two shell parts 7, 8 protrude substantially equally far in a direction transversely of the dividing plane D, the maximum dimension of shell 1 is in fact halved by the overturning. And because the dividing plane D runs substantially parallel to a front plane P of shell 1, which is defined by the front side F of seat surface 3 and an upper side T of backrest 4, in this case a forward protruding edge E close to the upper side of side wing 5, shell parts 7, 8 form in this position a relatively flat product which can be packaged in a relatively small packaging 20 (FIG. 5). This limits the transport costs when shell 1 is sent to an end user as part of a parcel. The small packaging 20 also has the advantage that it can be readily placed in a retail space, where space is usually scarce. In addition to cost considerations, it is an advantage that a smaller packaging is easier to handle for employees.

After receipt of packaging 20 with therein the shell parts 7, 8, these parts can be connected to each other again using the also supplied connecting means 12 when inner shell part 7 has been taken out of opening 12 and turned around. After shell parts 7, 8 have been connected to each other a filling can be arranged in the thus formed shell 1, for instance by arranging layers of foam at determined positions. Shell 1 with the filling received therein can then be covered with a seat cover, whereby a seat 2 with an attractive appearance is created. This seat 2 can then be mounted on the frame 21 of a race simulator 6, which further comprises a pedal box 22, a steering unit 23 and a screen 24 (FIG. 2).

The seat 2 of the race simulator 6 of FIG. 2 is otherwise based on a different shell 101 (FIG. 8). This shell 101 again consists of two shell parts 107, 108 which are connected releasably to each other along a dividing plane D. This dividing plane D, which once again runs substantially parallel to the plane P on the front side of shell 101, is in this case not straight but slightly curved, as can be seen in FIG. 6. In this second embodiment of shell 101 the front plane P is otherwise defined by the upper edge T of backrest 4 and a forward protruding edge E of side wing 105 close to the front side F of seat surface 103.

In the shown example edges 109, 110 additionally have a course which deviates locally from the dividing plane D. Edge 110 of the inner shell part 107 thus has in each case two recess 119 in side parts 105, while edge 110 of the outer shell part 108 has protruding parts 125 corresponding therewith. Edge 109 of inner shell part 107 also has a recess close to the front side F of seat part 103, while edge 110 of outer shell part 108 again has a protruding part 125 there. By contrast, edge 109 of inner shell part 107 has two protruding parts 125 close to the upper side T of backrest 104, while edge 110 of outer shell part 108 thus conversely has corresponding recesses 119 there. Owing to the co-acting recesses 119 and protrusions 125, the two shell parts 107, 108 are positioned accurately relative to each other and they are moreover well able to withstand loads in directions parallel to the dividing plane D and edges 109, 110.

In order to further increase the rigidity of edges 109, 110 they are in the shown example provided over their whole periphery with folded flanges 113, 114. In the shown example connecting means 112 take the form of clamps 126 which engage round flanges 113, 114 at the position of recesses 119 and protrusions 125. Clamps 126 are resilient to some extent and have in cross-section a U-shape with two legs 127 which are provided close to their free ends with inward directed hooking edges 128. These hooking edges 128 co-act with grooves (not shown here) in the mutually remote sides of flanges 113, 114 at the position of the recesses 119 and protrusions 125. Once they have been placed over flanges 113, 114, clamps 126 are thus held firmly, and the shell parts 107, 108 are thereby attached to each other in reliable manner (FIG. 8).

It can otherwise still be seen in these figures that backrest 104 is strengthened by two ribs 129 which extend through the protruding parts 125 and recesses 119 close to the upper side of backrest 104.

In the shown example openings 130 are arranged in shell part 107, in side parts 105, as well as an opening 131 in seat part 103A. Correspondingly, openings 132 are formed in outer shell part 108 close to the upper side of backrest 104B. These openings 130-132 are located at positions where, in a real racing seat, seatbelts are run through the bucket.

In the second embodiment, wherein the dividing plane D does not run straight, shell parts 107, 108 can be placed in each other in the same position in which they are also connected to each other. The inner shell part 107 is here thus not turned around, nor is it suspended in the opening 112 of outer shell part 108. Nevertheless, these shell parts 107, 108 can also be placed in each other very compactly and thus be received in a relatively small packaging. As can be seen in FIG. 6, the required height h1 of such a packaging is considerably smaller than the height h2 which would be necessary to package the shell 101 in a situation in which the schematically shown inner shell part 107' were to be assembled with the outer shell part 108.

In a third embodiment of shell 201 (FIG. 10) connecting means 211 once again comprise bolts 215 and nuts 216. In this embodiment edges 209, 210 of shell parts 207, 208 do not have outward protruding flanges, but overlap each other. For this purpose one of the shell parts, in this example the inner shell part 207, is joggled along a line 237 at some distance from its edge 209, whereby an outward displaced lap joint 233 is formed. In practice the shell part 207 will otherwise usually be manufactured from plastic, and will thus not actually have been subjected to a mechanical joggling process. In that case the outward displaced lap joint 233 will be formed in a mold in which or on which shell part 207 is formed, as will be discussed below.

In this example lap joint 233 of shell part 207 encloses the edge 210 of the other shell part 208 over the whole periphery. It is however also possible to envisage that it is precisely the shell part 208 which is provided with an outward displaced lap joint, which would then enclose the edge 209 of shell part 207. It is also possible to envisage embodiments wherein it is alternately the one or the other shell part that has an outward displaced lap joint.

Just as in the second embodiment, the edges 209, 210 of shell parts 207, 208 here follow a course which deviates locally from the dividing plane D. In this case edge 210 of outer shell part 208 is provided locally with protruding parts 225, while edge 209 of inner shell part 207 has recesses 219 corresponding therewith. These recesses 219 are otherwise covered by lap joint 233, since the joggled line 237 has a course which is complementary to that of edge 210.

In the shown example shell parts 207, 208 are connected to each other at the position of recesses 219 and protruding parts 225. For this purpose two openings 234 are formed in lap joint 233 at the position of each recess 219, while openings 235 corresponding therewith are formed in the protruding parts 225 of edge 210. In order to enable easy tightening of bolts 215 without having to hold nuts 216, the openings 234 in lap joint 233 are in this example enclosed on the outer side by an edge 236, the inner periphery of which has a shape corresponding to that of the outer periphery of nut 216, so in this case a hexagonal shape.

Shells 1, 101 and 201 according to the first, second and third embodiment otherwise not only differ from each other here in respect of construction and design, but can also differ from each other in respect of material and production method. Respective shell parts 7, 8 and 207, 208 of shell 1, 201, which is intended for a (relatively small) go-kart seat, can thus be formed by injection molding of plastic material. Shell parts 107, 108 of shell 101, which are intended for a racing seat, which is larger and will be loaded more heavily than a go-kart seat, can however be constructed from a composite material. These shell parts 107, 108 can for instance be manufactured from a composite material on the basis of glass fibers in a polyester matrix. Other fiber materials and other synthetic resins can also be envisaged, such as carbon fibers or aramid fibers and epoxy resin. Shell parts 107, 108 can then be manufactured with any known technique for the production of composite parts, for instance by arranging the fibers in or around an open mold and then impregnating them with the synthetic resin material for the matrix, and then allowing the thus formed composite to harden. Production techniques wherein a closed mold is applied, such as vacuum injection, pressure injection or RTM (Resin Transfer Molding), can also be envisaged.

Although the invention is described above on the basis of an embodiment, it will be apparent that it is not limited thereto but can be varied in many ways. Seats other than the shown bucket seats can thus also be constructed from parts which can be connected to each other in simple manner. In addition, the position and the direction of the dividing plane can be chosen differently than in the shown example. A longitudinal division in the centre or a division transversely through the side parts or wings could also be envisaged. In those cases the flanges would however have to take a very strong form, since this type of division entails a less favourable force transmission. And finally, the above described technique need not be limited to seats for simulators, but seats for other purposes can also be embodied divided in such a manner.

The scope of the invention is therefore defined solely by the following claims.

The invention claimed is:

1. A shell for a seat used in a simulator, the shell comprising:

a seat surface, a backrest, and side parts, wherein the shell comprises a rigid inner shell part and a rigid outer shell part with the outer shell part forming a collar around the inner shell part;

wherein each of the inner shell part and the outer shell part comprises a part of the seat surface and a part of the backrest;

wherein an entire edge of the inner shell part has a flat surface defining a first plane and an entire edge of the outer shell part has a flat surface defining a second plane, and the flat surfaces of the inner and outer shell parts are connected to each other such that the first plane and the second plane form a common dividing plane, and wherein the outer shell part has an opening bounded by its respective edge while the inner shell part is bounded by its outer edge, and the inner shell part fits overturned in the opening in the outer shell part.

2. The seat shell of claim 1, wherein the dividing plane runs substantially parallel to or at a small angle with a plane which connects a front side of the seat surface to an upper side of the backrest.

3. The seat shell of claim 2, wherein the inner and outer shell parts extend a substantially equal distance from the dividing plane when measured in a direction transversely thereof.

4. The seat shell of claim 1, wherein each edge comprises at least one flange protruding toward an outer side of the respective shell part, and the flanges are connected to each other.

5. The seat shell of claim 1, wherein the edges overlap each other at least over a part of their periphery.

6. The seat shell of claim 1, wherein the edges have complementary courses which deviate locally from the dividing plane.

7. The seat shell of claim 1, wherein each of the inner shell part and the outer shell part has connecting means co-acting with the other one of the inner shell part and the outer shell part.

8. The seat shell of claim 7, wherein the connecting means are arranged at least partially on an outer side of each of the inner shell part and the outer shell part.

9. The seat shell of claim 1, wherein at least one of the inner and outer shell parts is manufactured from a plastic.

10. The seat shell of claim 1, wherein at least one of the inner and outer shell parts is manufactured from a composite material.

11. A method for transporting a shell for a seat comprising a seat surface, a backrest and side parts, the method comprising:

providing a rigid inner shell part and a rigid outer shell part which can be connected releasably to each other to form the shell, wherein the outer shell part forms a collar around the inner shell part;

placing the inner and outer shell parts in each other; and placing the inner and outer shell parts which are placed in each other in a packaging;

wherein an entire edge of the inner shell part has a flat surface defining a first plane and an entire edge of the outer shell part has a flat surface defining a second plane, and the flat surfaces of the inner and outer shell parts are connected to each other such that the first plane and the second plane form a common dividing plane, wherein the outer shell part has an opening bounded by its respective edge, and wherein the step of placing the inner and outer shell parts in each other comprises of placing the inner shell part in the opening of the outer shell part; and wherein the inner and outer shell parts are connectable to each other in a first position to form the seat, and wherein the inner shell part is configured to be placed in the opening overturned relative to the first position.

12. The method of claim 11, wherein at a destination the inner and outer shell parts are removed from the packaging, are separated from each other and are connected releasably to each other to form the seat.

13. The method of claim 11, wherein after being separated, one of the inner and outer shell parts is turned around before the inner and outer shell parts are connected to each other.

14. A packaging with inner and outer shell parts placed therein, formed by the method of claim 11.

* * * * *